US005476561A

United States Patent [19]

Bylund et al.

[11] Patent Number: 5,476,561

[45] Date of Patent: Dec. 19, 1995

[54] METHOD FOR PRODUCING MELTED AND DELUSTERED CAMOUFLAGED FABRIC

[75] Inventors: Don M. Bylund; Howard C. Willauer, Jr.; James R. Reynolds, all of Spartanburg, S.C.

[73] Assignee: Milliken Research Corporation, Spartanburg, S.C.

[21] Appl. No.: 123,456

[22] Filed: Sep. 17, 1993

Related U.S. Application Data

[63] Continuation-in-part of Ser. No. 898,332, Jun. 15, 1992, Pat. No. 5,261,978.

[51] Int. Cl.[6] ..... B32B 31/00

[52] U.S. Cl. ..... 156/85; 156/268

[58] Field of Search ..... 156/84, 85, 223, 156/257, 268, 227, 272.2, 275.1

[56] References Cited

U.S. PATENT DOCUMENTS

| | | | |
|---|---|---|---|
| 2,524,895 | 10/1950 | Dodge | 8/131 |
| 3,069,796 | 12/1962 | Ruter | 41/10 |
| 3,395,066 | 7/1968 | Tucker | 161/73 |
| 3,703,432 | 11/1972 | Koski | 161/110 |
| 3,769,120 | 10/1973 | Chandler | 156/84 |
| 3,790,652 | 2/1974 | Colijn et al. | 264/146 |
| 4,364,156 | 12/1982 | Greenway et al. | 26/2 R |
| 4,375,488 | 3/1983 | Hogan | 428/17 |
| 4,418,451 | 12/1983 | Crenshaw | 26/2 R |
| 4,471,514 | 9/1984 | Stokes | 26/2 R |
| 4,931,320 | 6/1990 | Leonard | 428/17 |
| 5,013,375 | 5/1991 | Leonard | 156/61 |
| 5,261,978 | 11/1993 | Reynolds | 156/84 |

FOREIGN PATENT DOCUMENTS

| | | |
|---|---|---|
| 1034070 | 7/1958 | Germany . |
| 347737 | 8/1960 | Switzerland . |

*Primary Examiner*—Christopher W. Raimund
*Attorney, Agent, or Firm*—Kevin M. Kercher; Terry T. Moyer

[57] ABSTRACT

Method and apparatus for developing an improved camouflaged product comprising of an open mesh, net substrate to which is bonded a sheet material. This sheet is colored in the desired pattern and bonded to a substrate along spaced lines of attachment between adjacent lines of bonding to the net substrate. In this formation, indefinite length webs of the net substrate and a continuous sheet may be combined in faced relation and stitch-bonded along spaced parallel continuous lines to form continuous parallel channels or pockets along the length of the composite material. The composite net and sheet material is passed to a cutting machine having a plurality of generally U-shaped guide members that separate and space the net substrate from the sheet. As the composite moves through the guide members, a plurality of spaced heated air cutters to reside and reciprocate slightly above the sheet to cut a generally sinuous path between the lines of the stitches. Separate lobes are formed on each side of the lines of stitching to simulate the appearance of natural objects of the terrain such as leaves or foliage and then are heated to over 400 degrees Fahrenheit to wrinkle and deluster the camouflage lobes thereby significantly enhancing camouflaged properties, such as creating a wrinkled three-dimensional effect and significantly decreasing luster.

12 Claims, 10 Drawing Sheets

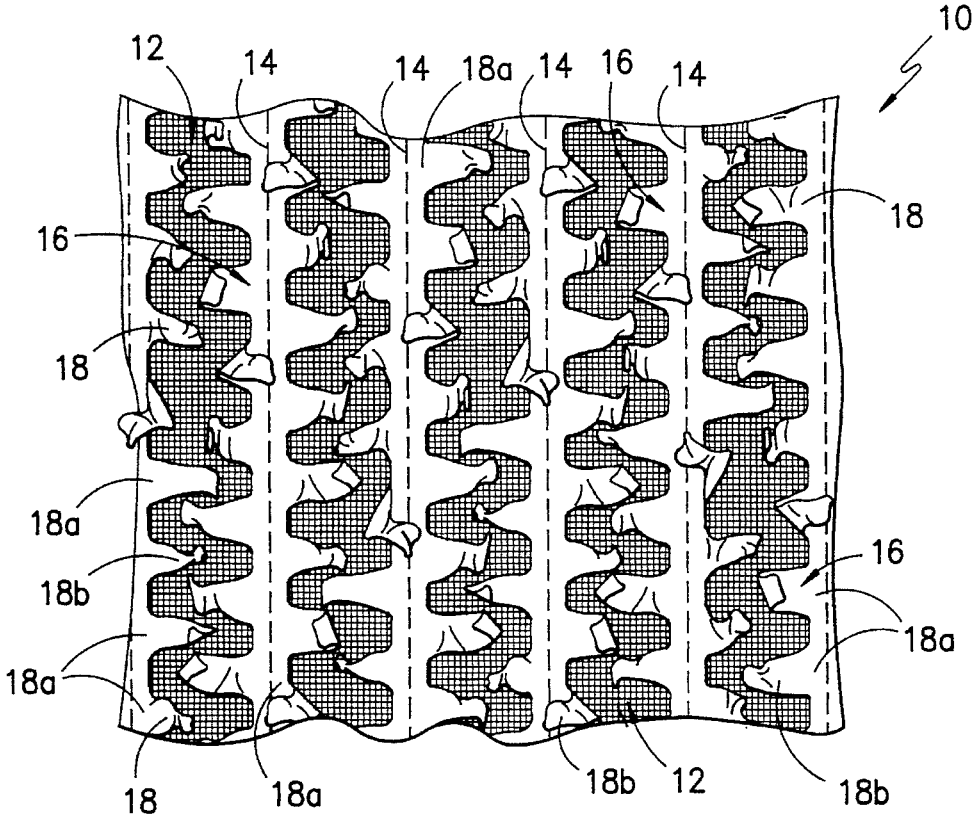
FIG. —1—
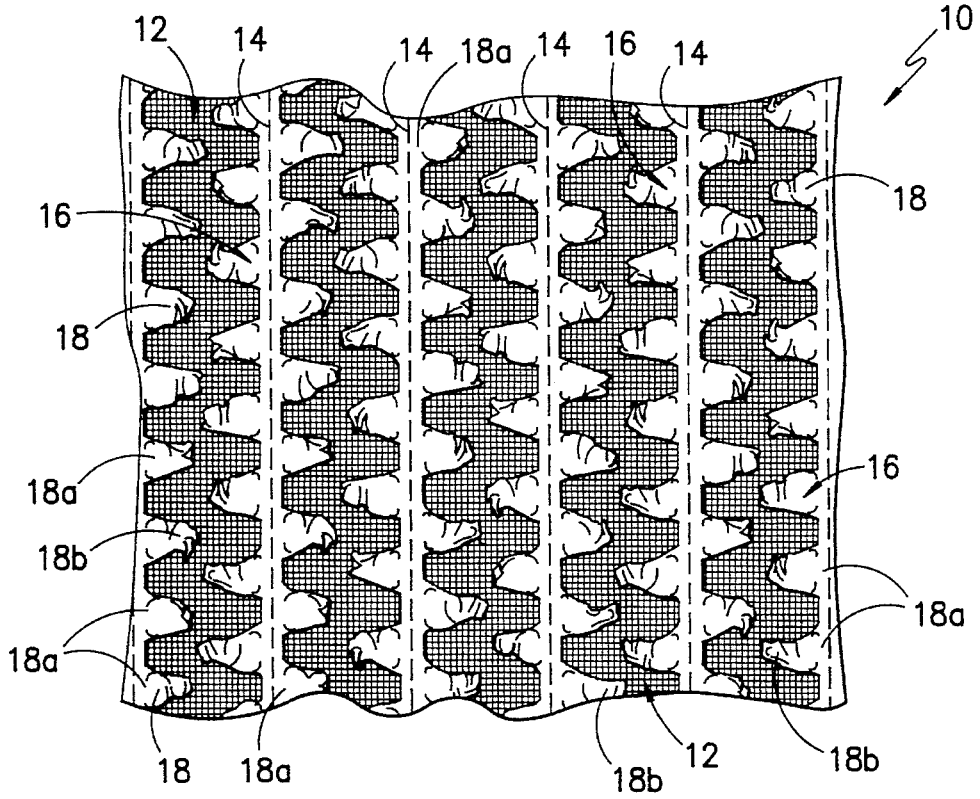
FIG. —2—

METHOD FOR PRODUCING MELTED AND DELUSTERED CAMOUFLAGED FABRIC

CROSS-REFERENCE TO RELATED APPLICATION

This application is a continuation in part of U.S. application Ser. No. 07/898,332, filed Jun. 15, 1992, now issued as U.S. Pat. No. 5,261,978.

BACKGROUND OF THE INVENTION

This invention relates to a melted and delustered camouflaged fabric. Camouflaged materials have long been employed to conceal objects, personnel, and equipment in various terrains from visual detection. These camouflaged materials are drapable sheets or net structures of varying shapes and sizes. Camouflaged materials can be either a solid color or dyed or printed in multiple patterns to simulate the coloration of the terrain in which the camouflage is utilized. Typical examples include patterns of black, brown, and green colorants. Camouflaged material can be supported or draped around objects or equipment to be concealed with the ability to join multiple pieces of camouflage together at their edges to provide for a particular size depending on the size of the objects or equipment to be concealed.

U.S. Pat. Nos. 3,069,796; 4,323,605; and 4,375,488 disclose camouflage materials consisting of flexible, two-dimensional sheets in which a pattern of cuts is made to provide holes and flaps simulating pieces of various multicolored foliage. U.S. Pat. No. 4,493,863 discloses a laminated camouflage sheet composed of a blown, low density polyethylene layer, a vaporized metal layer, an adhesion film, and a woven cloth layer. The blown layer is die cut by a stamping apparatus to form arcuate slits which form tongues under action of internal stresses to curl outwardly from the plane of the camouflage sheet. Other types of camouflage material include that disclosed in commonly assigned U.S. Pat. No. 5,281,451 and U.S. Pat. No. 5,261,978. Both patent disclosures are hereby incorporated by reference as is fully set forth herein. These Applications disclose a composite product comprised of an open mesh, net substrate which is bonded to a sheet material such as a woven fabric, film, non-woven, or the like. The sheet is colored in a desired camouflage pattern, bonded to the substrate along spaced lines of attachment, and cut to simulate the appearance of natural objects of the terrain, such as leaves or foliage, between adjacent lines of bonding to the net substrate. In its formation, indefinite length webs of a net substrate and a continuous sheet may be combined in faced relation and stitch-bonded along spaced parallel continuous lines, as by use of a Malimo® stitch-bonding machine or a quilting machine, to form continuous parallel channels or pockets along the length of a composite material. The composite net and sheet material is thereafter passed through a cutting machine having a plurality of generally U-shaped guide members disposed across the path of movement of the composite to enter each channel of the composite net and sheet and separate and space the net substrate from the sheet. As the composite moves through the guide members, a plurality of spaced, heated cutting wires engage the sheet transversely and reciprocate between the lines of stitches to cut a generally sinuous path through the sheet. The fabric lobes thus are formed on each side of the line of stitching to simulate the appearance of natural objects of a terrain such as leaves or foliage. The fabric is then heated to a temperature of 160° to 220° Fahrenheit to soften the lobes, without melting, wrinkling or delustering, while passing downwardly to allow lobes to fall away from the mesh. The lobes tend to fold on themselves while passing around a roller which creases the folds. A significant problem with this camouflaged composite product is that the leaves remain relatively flat and have a high degree of luster. This is very easy for the enemy to detect. Furthermore, there is no wrinkling which is absolutely necessary to convey to the camouflage lobes the shape of actual leaves or foliage. Furthermore, this structure is not very open to the outside, therefore an observer standing under the net could not easily and accurately identify threats from the outside. Furthermore, this merely falling away and folding does not achieve a true and permanent three-dimensional effect which is also a prerequisite to achieving a product which can easily evade enemy detection.

The present invention solves these problems in a manner not disclosed in the known prior art.

SUMMARY OF THE INVENTION

The present invention is directed to an apparatus and process for developing an improved camouflaged product comprising of an open mesh, net substrate to which is bonded a sheet material, such as woven fabric, film, non-woven, or the like. This sheet is colored in the desired pattern and bonded to a substrate along spaced lines of attachment, and cut to simulate the appearance of natural objects of the terrain, such as leaves or foliage between adjacent lines of bonding to the net substrate. In this formation, indefinite length webs of the net substrate and a continuous sheet may be combined in faced relation and stitch-bonded along spaced parallel continuous lines to form continuous parallel channels or pockets along the length of the composite material. The composite net and sheet material is passed to a cutting machine having a plurality of generally U-shaped guide members disposed across the path of movement of the composite to enter each channel of the composite net and sheet and separate and space the net substrate from the sheet. As the composite moves through the guide members, a plurality of spaced heated air cutters engage the sheet transversely and reciprocate between the lines of the stitches to cut a generally sinuous path through the sheet. Separate lobes are formed on each side of the lines of stitching to simulate the appearance of natural objects of the terrain such as leaves or foliage and then are heated to over 400 degrees Fahrenheit to wrinkle and deluster the camouflage lobes thereby significantly enhancing the camouflage properties, such as creating a wrinkled three-dimensional effect and significantly decreasing luster.

It is an advantage of this invention that the wrinkling of the leaves removes the two-dimensional flatness of the camouflage thereby making the camouflage composite more difficult to detect.

Another advantage of this invention is the lack of reflection of the net due to the delustering which also makes the camouflage composite extremely difficult to detect.

Another advantage of this invention is that an observer standing under the net can more easily and accurately identify threats from the outside due to the more open structure.

These and other advantages will be in part apparent and in part pointed out below:

BRIEF DESCRIPTION OF THE DRAWINGS

The above as well as other objects of the invention will become more apparent from the following detailed description of the preferred embodiments of the invention when taken together with the accompanying drawing, in which:

FIG. 1 is a plan view of a portion of camouflage construction of the present invention, showing fabric lobes that are wrinkled and delustered in accordance with the present invention to the extent that the fabric lobes are approximately seventy percent of their original size.

FIG. 2 is a plan view of the portion of the camouflage construction of the present invention, showing fabric lobes that are wrinkled and delustered in accordance with the present invention to the extent that the fabric lobes are approximately fifty percent of their original size.

DETAILED DESCRIPTION OF THE PREFERRED EMBODIMENT

Figure 3:
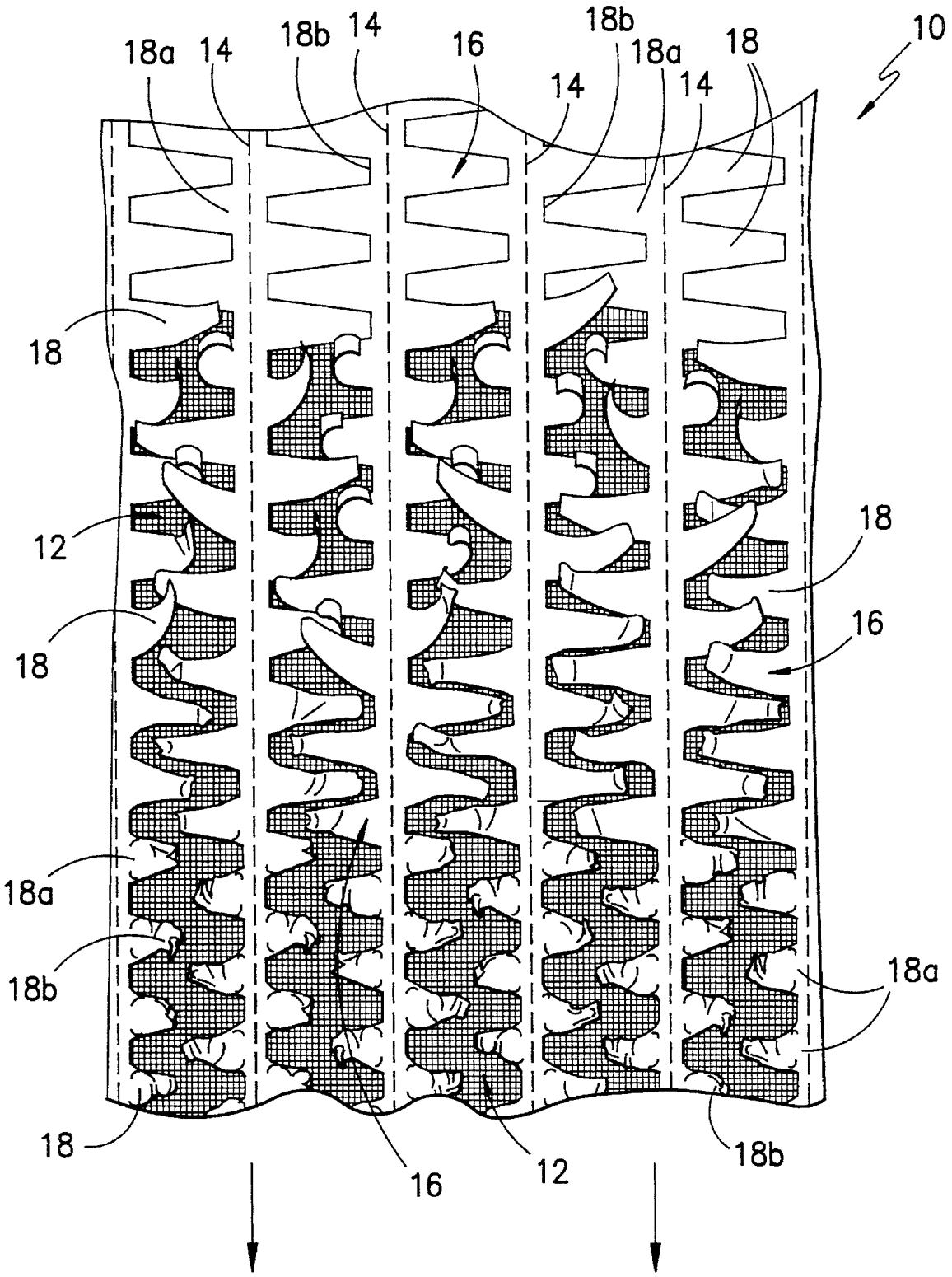
FIG. 3 is a plan view of the portion of camouflage construction of the present invention, showing fabric lobes of the construction in process of the present invention in which the lobes are initially flattened, then curled, and finally wrinkled and delustered in accordance with the present invention.
Figure 4:
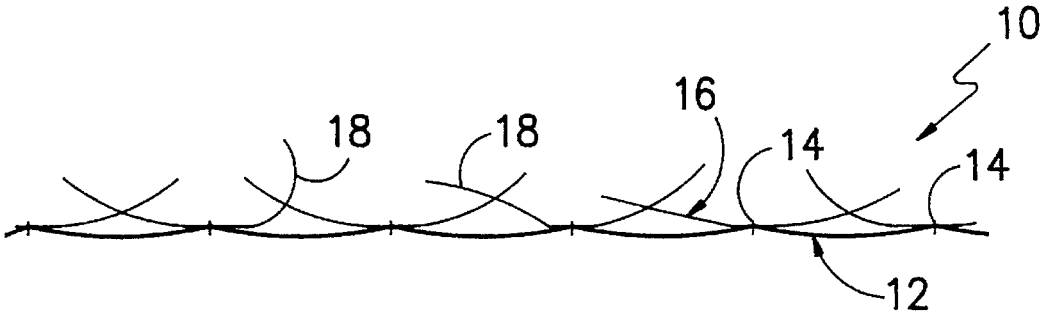
FIG. 4 is a depiction of a cross-section of the camouflage construction prior to heat treatment.
Figure 5:
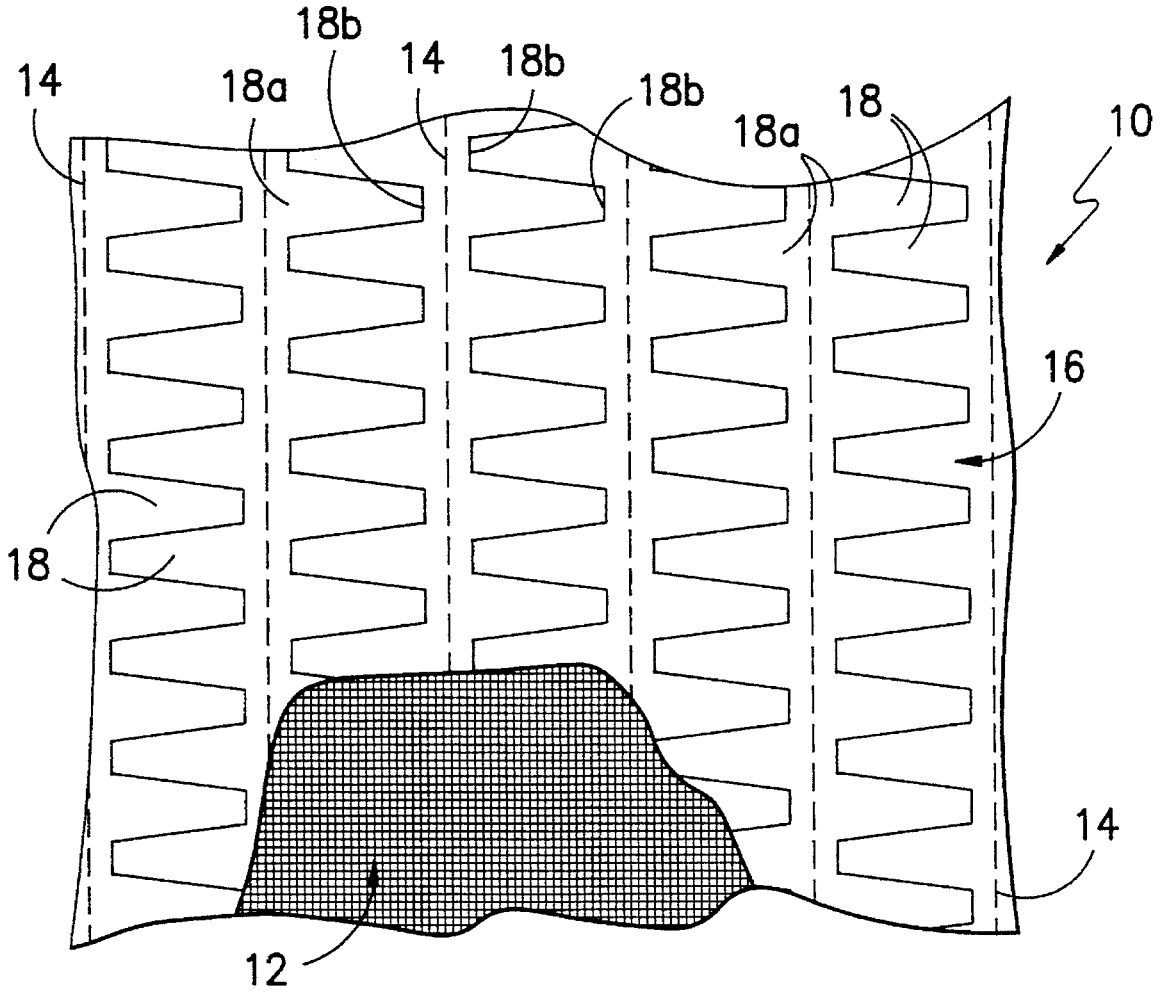
FIG. 5 is a plan view depiction of a portion of the camouflage construction, showing the fabric lobes of the construction in flattened condition to better illustrate one pattern of cut which may be employed in forming the lobes of the construction.

Referring now to the accompanying drawings, initially to FIGS. 1, 2, and 3, which are a top plan view depiction of a portion of a camouflage construction, showing lobes that simulate the natural objects of a terrain, e.g. leaves or foliage, that have been wrinkled and delustered according to the present invention. FIG. 1 shows the camouflage lobes only slightly wrinkled to the extent that the camouflage lobes are seventy percent of original size while FIG. 2 shows the camouflage lobes being significantly wrinkled to the extent that the camouflage lobes are only fifty percent of original size. FIG. 3 shows the transition of the camouflage lobes through Applicant's process from the initial cutting to the final state of being wrinkled and delustered. As shown in FIGS. 1–3, the composite camouflage construction 10 comprises a drapable, small mesh net substrate 12, such as a textile Raschel knit fabric, which may be formed of a suitable textile yarn, such as nylon, polyester, or the like. Bonded to the supporting net substrate, and face-to-face relation therewith, and in parallel spaced lines of attachment along the length of the construction, as by bonding stitches 14 such as by thread, is a continuous sheet 16 of suitable material, such as a woven nylon or polyester fabric. As shown, the continuous fabric sheet 16 is cut between the adjacent parallel lines of thread bonding stitching 14 to form a plurality of lobes 18. Each lobe 18 has a base position **18*a* attached to the net substrate 12 by the threaded bonding stitches 14, and a loose end portion 18*b* which is free of the substrate 12** to move in simulation of leaves or foliage.

The net substrate 12 and the continuous fabric sheet 16 bonded thereto are colored, as by printing or dyeing, in a desired camouflaged pattern. For example, the net substrate 12 may be dyed black and the continuous fabric sheet 16 may be dyed in various random colors of green, brown, black to conform to the colors of the terrain in which the camouflage construction is to be employed.

The overall size and shape of the camouflage construction may vary, depending on size requirements of equipment or apparatus to be concealed thereby. Typically, individual camouflage construction units may be 50 feet in width and 50 feet in length, with the side edges of each unit being taped or sewn about its periphery. The edges of the units may further be provided with suitable attaching means, such as tie cords, or mating hook and loop pile fabric fasteners, to secure a number of individual units together and form a larger system of camouflage units.

The mesh size of the net substrate 12 may vary, but preferably is a small enough mesh size so as to not snag on equipment or objects to be concealed, e.g., parts of fixed or rotary wing aircraft. Mesh size also should be sufficient to permit passage of air therethrough and provide low wind resistance of the camouflage constructions in their geographic areas of use.

The distance between the adjacent parallel lines of attachment such as by threaded bonding stitches 14 may be varied, depending on the particular shape and size of the camouflage lobes 18 to be formed in the continuous fabric sheet 16. Typically, the lines of attachment may be in generally parallel rows spaced 3 inches apart along the length of the camouflage construction.

Although the net substrate 12 and the continuous fabric sheet 16 may be formed of textile materials, such as woven, non-woven, or knit fabrics, it is contemplated that they may be formed of other material, such as a plastic laminate or a continuous plastic film, of suitable drapeability, strength, and service characteristics as to be pattern dyed in a camouflage configuration. Similarly, although the lines of the attachment of the sheet and net substrate may be sewn stitches, as in a sewing stitch-bonding operation. It is contemplated that lines of attachment may be formed by other means, such as adhesive bonding, heat bonding, or the like, provided the bonding means does not incorporate materials which may damage, contaminate, or snag upon the surfaces of the objects to be concealed by the camouflage construction. A typical camouflage construction of the present invention may be a two ply, high tenacity, 70 denier polyester Raschel knit substrate having a mesh size of approximately 1/10 inch opening and a weight of about 2.1 ounces per square yard combined with a 70 denier polyester woven Pongee fabric having a 80×76 picks per inch count and a weight of approximately 1.75 ounces per square yard.

Method and apparatus for producing the lightweight camouflage in accordance with the present invention can best be described by reference to FIGS. 4–9, and FIG. 14. As seen in schematic side elevation view in FIG. 9 and 14, an indefinite length of continuous sheet material, such as woven fabric 20, and an indefinite length web of open mesh net substrate such as a knitted mesh fabric 22, directed from supply rolls 24 and 26 by suitable guide means, such as rollers or bars 28, and in contiguous facing relation along a desired path of travel. Placed in the path of travel are bonding means, such as a sewing station 30, containing a plurality of individual sewing heads 31 spaced across the path to stitch the woven fabric 20 to the knitted mesh fabric 22 along spaced parallel lines in the form of threaded bonding stitches 14 (FIGS. 1, 2, and 3) in the direction of movement of the woven fabric 20 and knitted mesh fabric 22. Typically, the sewing means might be a Malimo® stitch-bonding machine which is well known and used in the industry. Stitch-bonding of the sheet and substrate along plural lines of attachment during its movement through the bonding means produces a plurality of continuous open-ended pockets or channels 32 (FIG. 8) in the composite bonded structure.

Figure 6:
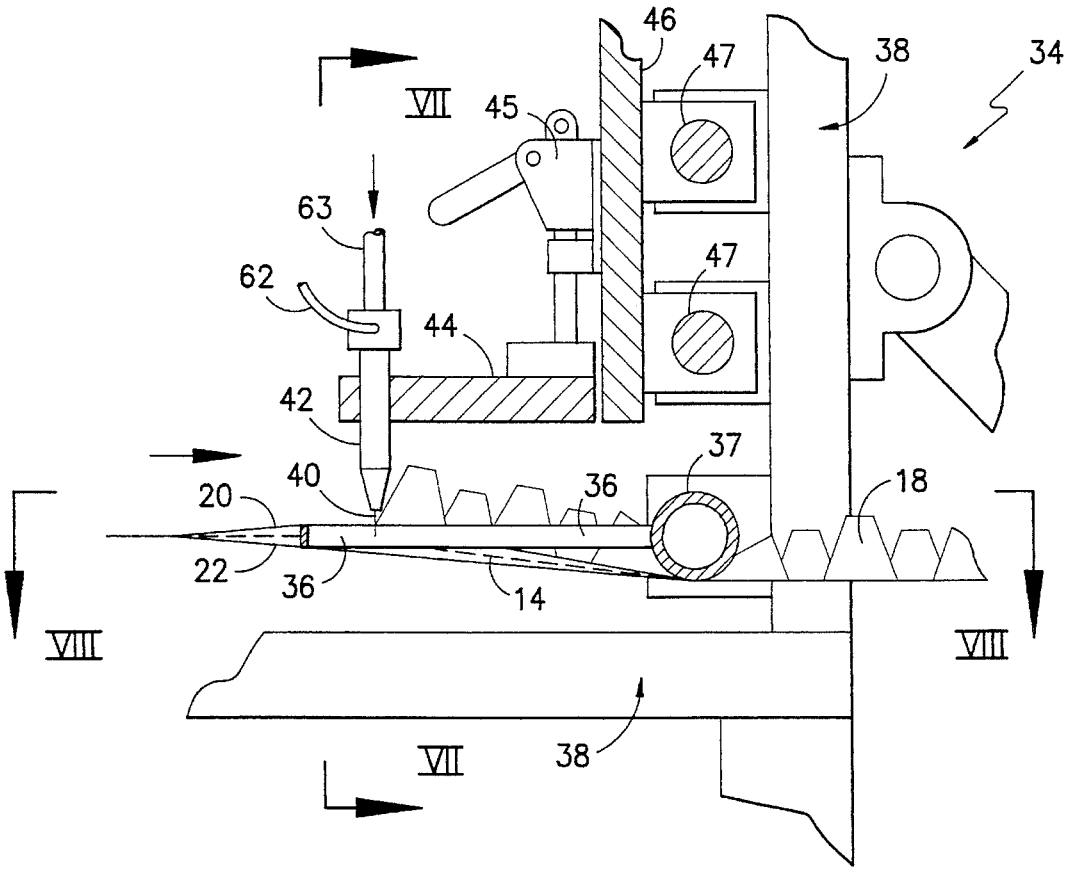
FIG. 6 is an enlarged sectional elevation view of the cutting head of the cutting station of the apparatus of FIGS. 9 and 14, taken along line VI—VI of FIG. 7 and looking in the direction of the arrows.
Figure 7:
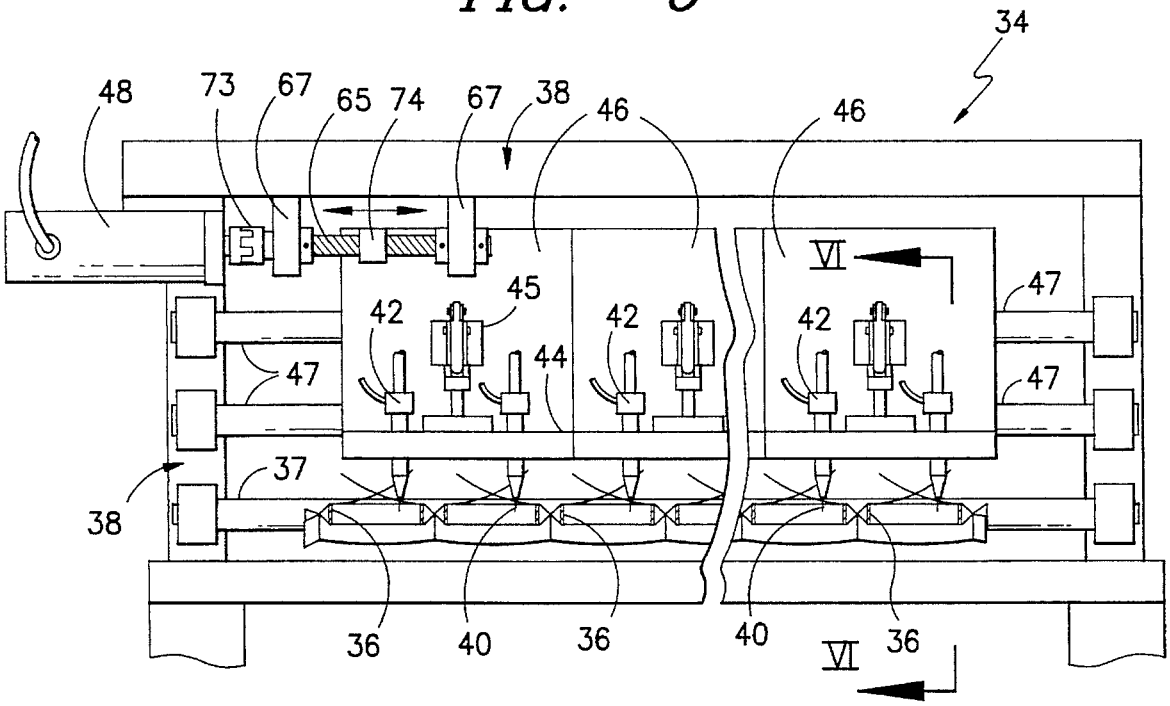
FIG. 7 is a front elevation view of a portion of the cutting head station of the apparatus of FIGS. 9 and 14, looking generally in the direction of arrows VII—VII of FIG. 6.
Figure 8:
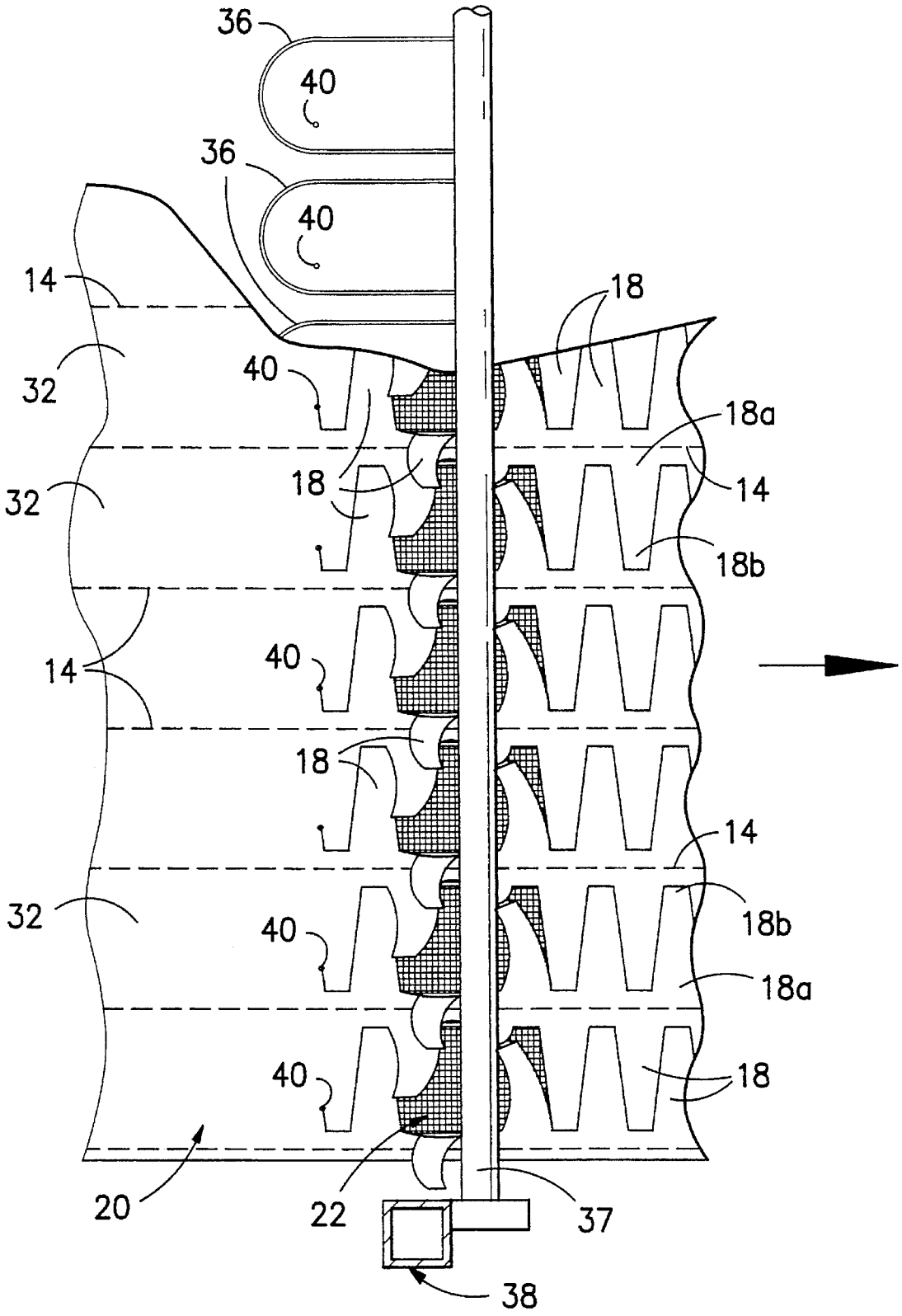
FIG. 8 is a top plan view of a portion of the cutting head of the cutting station of the apparatus of FIGS. 9 and 14, taken generally along line VIII—VIII of FIG. 6, and looking in the direction of the arrows.

Positioned in the path of travel of the composite bonded sheet and substrate after the sewing station 30 are cutting means, located at a cutting station 34. As seen in FIG. 6–9 and FIG. 14, cutting station 34 includes a plurality of general U-shaped guides 36 mounted in a spaced relation across the path of travel of the woven fabric 20 and knitted mesh fabric 22 on a cross-member 37 of support frame 38. As the composite web moves in its longitudinal path of travel, the U-shaped guides 36 pass into each of the channels 32 formed between adjacent lines of attachment of the woven fabric 20 and knitted mesh fabric 22 (FIGS. 6 and 8). Each U-shape guide 36 is of a sufficient thickness and height (FIG. 6) to separate and space the face of the sheet of woven fabric 20 from the face of the knitted mesh fabric 22. Mounted for reciprocating movement, transverse to the path of travel of the woven fabric 20 and knitted mesh fabric 22, are cutting means, shown as a plurality of electrically heated hot air cutters 42, each of which is supported by a mounting bar 44. Mounting bar 44 is attached by an elevator mechanism 45 to a cross beam 46 on the support frame 38. The cross beam 46 is mounted on rods 47 for transverse reciprocation on support frame 38 across the path of travel of the composite web of woven fabric 20 and knitted mesh fabric 22. Cross beam 46 is reciprocated by a suitable drive means, such as servo motor 48 that is coupled to a ball screw 65 by means of a coupler 73. The ball screw 65 is rotatably attached to support frame 38 by means of a dual attachment members 67 and the ball screw nut 74 is fixedly attached to cross beam 46. As best seen in FIGS. 6 and 7, each electrically heated air cutter 42 extends downwardly to reside and reciprocate slightly above each U-shaped guide member 36, and electrical energy is supplied from a suitable supply source to electrical wire 62 to a heat the inside of air cutter 42 to the desired temperature and air is supplied from a suitable supply source to air conduit 63 which injects the air into the air cutter 42 to cut the continuous woven fabric 20 without cutting the supporting knitted mesh fabric 22 by means of heated air stream 40.

Figure 9:
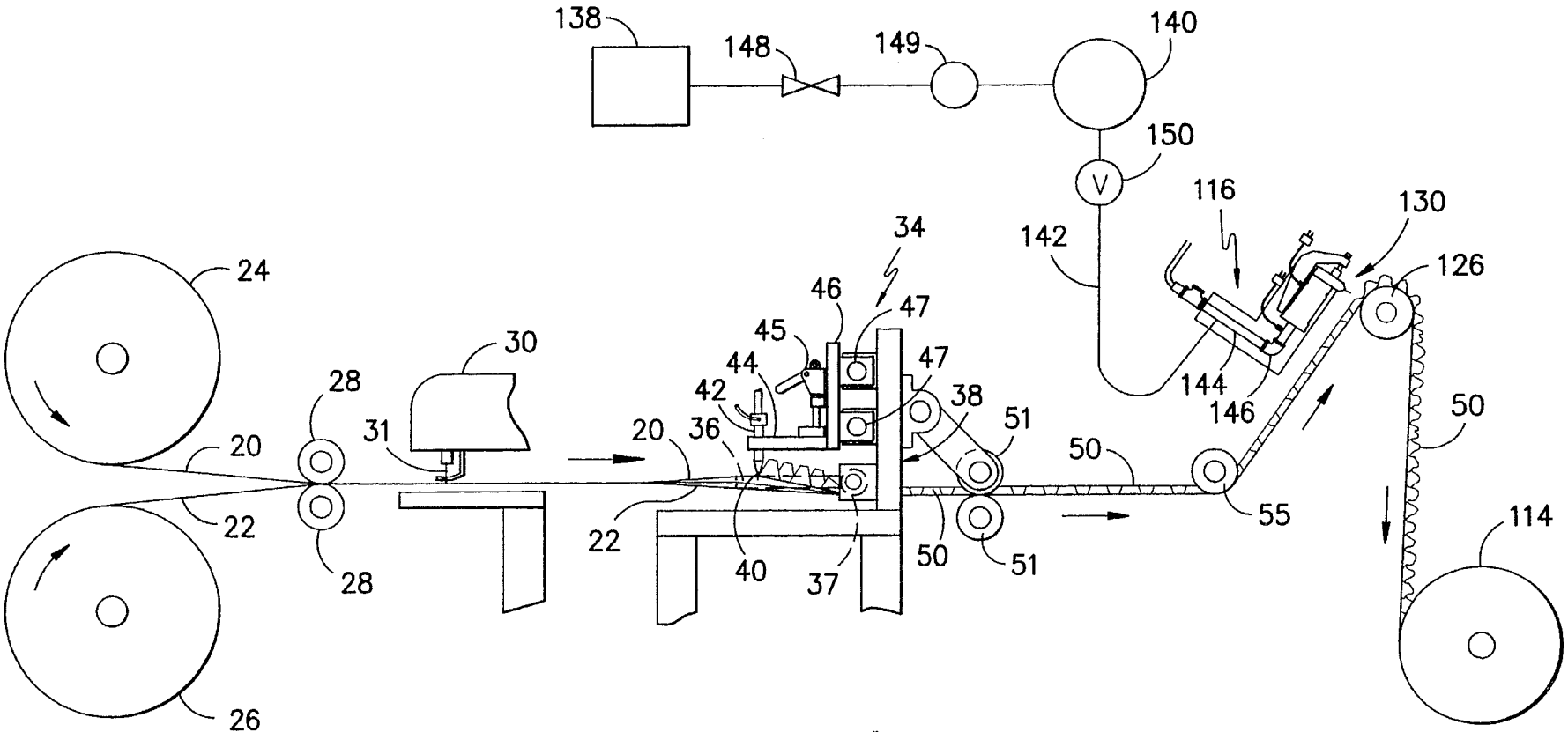
FIG. 9 is a schematic side elevation view of an apparatus for wrinkling and delustering camouflaged lobes of a moving web of camouflage material utilizing heated pressurized gas and incorporating novel features of the present invention.

Operation of the servo motor 48 driving the ball screw 65 thus reciprocates the cross beam 46 holding each of the electrically heated air cutters 42 to move transversely back and forth slightly above each of their U-shaped guides 36 as the woven fabric 20 and knitted mesh fabric 22 move through the cutting station 34. The electrically heated air cutters 42 cut the woven fabric 20, between the adjacent threaded bonding stitches 14, into a plurality of lobes 18, thus opening each of the channels 32 formed in the woven fabric 20 and knitted mesh fabric 22 as it passes through the cutting station 34. The shape and configuration of lobes 18 prior to heating may be varied, as desired, depending on the speed of movement through the cutting station 34 and the speed of reciprocation of the electrically heated air cutters 42. The speed of movement of the electrically heated air cutters 42 may be adjusted by adjustment of the servo motor speed. Various programming means well known in the art may be employed to provide varying and various patterns of lobes, as desired. Operation of the cutting station may be computer-controlled, if desired. As shown in the preferred embodiment of FIGS. 1–3, electrically heated air cutters 42 are reciprocated to provide a lobe configuration resembling a somewhat truncated triangle, the outer end **18*b* of each lobe 18 having a straight edge extending in the direction of the lines of attachment (bonding stitches) 14 and side portions of the lobe flaring to the base portion 18*a* which is attached to the substrate by threaded bonding stitches 14. As shown in FIG. 9, camouflage construction 50 leaving cutting station 34 looks like the construction shown in FIG. 8 and the lobes 18 tend to be flat against the mesh net substrate 12** when placed over an object to be hidden.

The camouflage construction may be suitably dyed or printed in a desired camouflage configuration of random coloration. The woven fabric 20 and knitted mesh fabric 22 preferably may be dyed or printed prior to bonding and cutting. Typically, the knitted mesh fabric 22 forming the net substrate which supports the woven fabric 22 in the form of a continuous sheet may be dyed black, or a neutral background shade, and the continuous sheet may be patterned in random green, brown, black coloration to conform to terrain in which the camouflage construction is employed. As mentioned, the particular mesh size of the net support substrate may be varied, but preferably it is sufficiently small size as to not snag on objects or equipment to be concealed. Similarly the distance between the stitch lines of attachment of the sheet to the substrate may vary, depending upon the length and the size of the lobe desired for simulation of leaves or foliage.

If desired, the camouflage construction may be made reversible to present different camouflage patterns of coloration on opposite sides, e.g., a forest terrain and a desert terrain. Both faces of the net substrate may be bonded to continuous sheets and both sheets cut, as described, to produce lobes simulating natural objects of a terrain. In such cases, two cutting stations could be employed or the composite web run through a single cutting station twice.

The wrinkling and delustering of camouflage lobes presents a very significant advantage over what is previously known in the prior art. This wrinkling removes the observed flatness characteristic of the camouflage system and adds a more realistic textured appearance to the camouflage. This improved wrinkled camouflage most closely resembles the terrain background and thus is significantly more difficult to detect than the composite camouflaged product disclosed in U.S. Pat. Nos. 5,281,451 and U.S. Pat. No. 5,261,978 from the same viewing point. This was experimentally proven by one of a BYK-Gardner, Inc.'s micro TRI gloss reflectometer at 85° BYK-Gardner, Inc. is located at 2435 Linden Lane, Silver Spring, Md. 20910. The prior product produced by the above two Patent Applications provided an average gloss reading of 0.3 for five samples while Applicant's Invention provided an average gloss reading of 0.0 for five samples. Furthermore, this delustering allows the camouflage net to blend into the terrain background which typically has a low degree of luster. This delustering of the camouflage net resulting in low degree of reflection makes the composite camouflage difficult to detect. Furthermore, an additional significant advantage of melting and wrinkling camouflage lobes is that an observer standing under the camouflage net can more easily and accurately identify threats from the outside. This is due to the more open structure of the camouflage product.

The preferred means of wrinkling and delustering camouflage lobes is the application of heated pressurized gas streams to the camouflage construction 50. As shown in FIG. 9, as the camouflage construction 50 leaves cutting station 34 and passes through guide roll 51 and guide roll 55 and then moves closely adjacent to the heated fluid discharge outlet of an elongate fluid distributing manifold assembly 130 of treating unit 116. The camouflage construction 50 thereafter passes over main driven textile fabric support roll 126 and then on to take-up roll 114 for collection. There may be an amount of overfeed or underfeed of the composite construction 50 in the range of a positive 2.5 percent or a negative 2.5 percent. The amount of negative tension or positive tension depends on the construction, weave type and other factors relating to the camouflage construction 50. The preferred speed of the camouflage construction 50 is between 2 and 12 yards per minute.

As illustrated in FIG. 9, fluid treating unit 116 includes a source of compressed gas, such as an air compressor 138, which supplies pressurized air to an elongated air header pipe 140. Header pipe 140 communicates by a series of air lines 142 spaced uniformly along its length with a bank of individual electrical heaters indicated generally at 144.

The heaters 144 are arranged in parallel along the length of heated fluid distributing manifold assembly 130 and supply heated pressurized air thereto through short, individual sir supply lines, indicated at 146, which communicate with assembly 130 uniformly along its full length. Air supplied to the heated fluid distributing manifold assembly 130 is controlled by a master control valve 148, pressure regulator valve 149, and individual precision control valves, such as needle valves 150, located in each heater air supply line 142. The heaters 144 are controlled in suitable manner, as by temperature sensing means located in the outlet lines 146 of each heater, with regulation of air flow and electrical power to each of the heaters to maintain the heated fluid at a uniform temperature and pressure as it passes into the manifold assembly along its full length. Typically, the range of temperature will be between 450 and 1200 degrees Fahrenheit for the heated pressurized gas which translates to a temperature range of 400 to 1100 degrees Fahrenheit for the camouflage construction 50. The preferred operating temperature range given camouflage construction 50 depends upon: the components of the camouflage construction, the construction of the camouflage construction, the desired effect, the speed of transfer of the camouflage construction, the pressure of the heated pressurized gas, the tension of the camouflage construction, the proximity of the camouflage construction to the treating manifold, among others.

The heated fluid distributing manifold assembly 130 is disposed across the full width of the path of movement of the camouflage construction 50 and closely adjacent the surface thereof to be treated. Although length and manifold assembly may vary, typically in the treatment of camouflage construction materials, length of the manifold assembly may be 76 inches or more to accommodate camouflage construction of about 72 inches in width.

Figure 10:
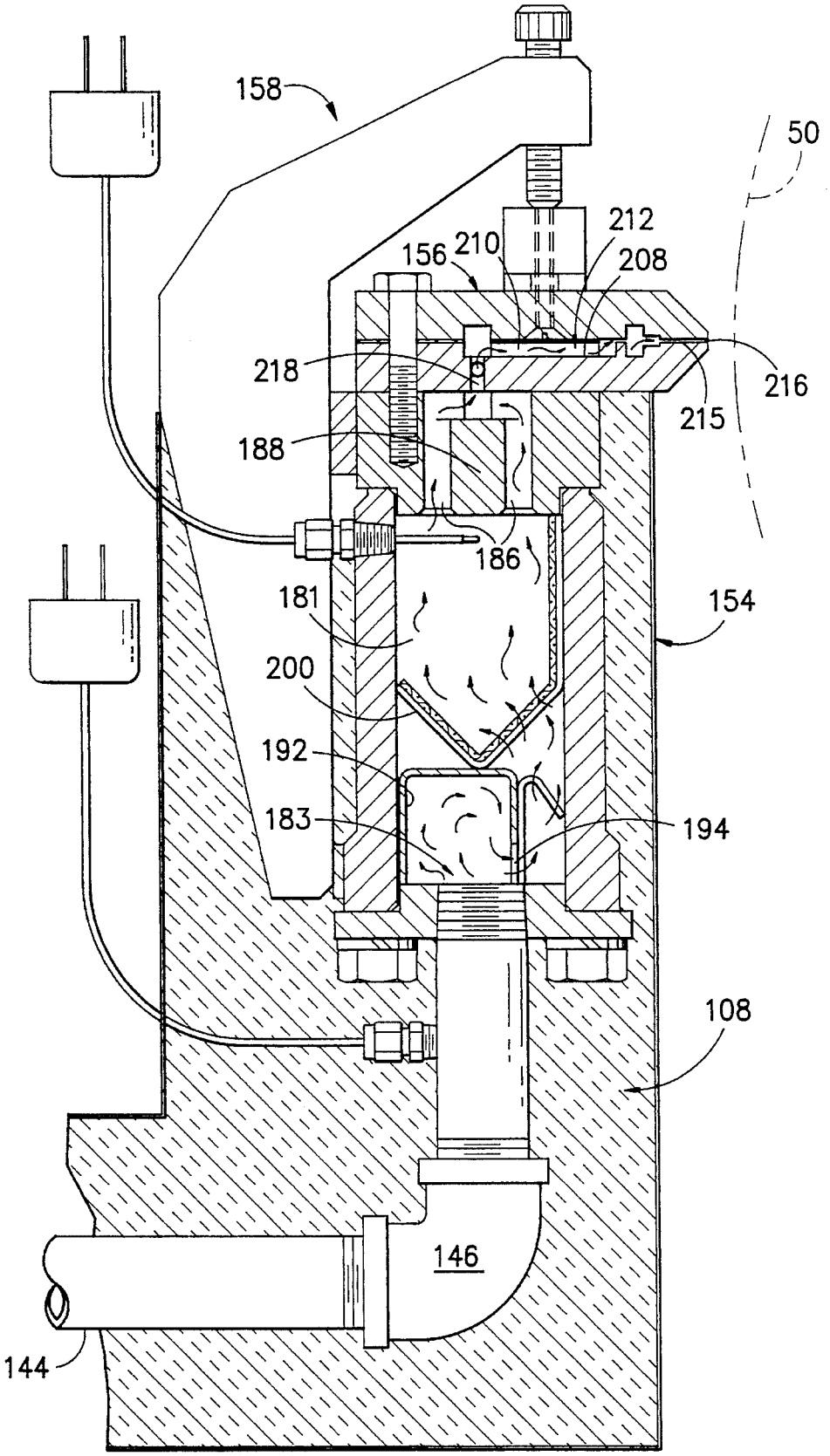
FIG. 10 is an partial sectional elevation of the fluid distributing manifold assembly of the apparatus of FIG. 9.

Details of the heated fluid manifold assembly 130 may be best described by reference to FIGS. 10–11 of the drawings. As seen in FIG. 10, which is a partial sectional elevation view through the assembly, there is a first elongated manifold housing 154 and a second smaller elongated manifold housing 156 secured in fluid type relationship therewith by a plurality of spaced clamping means, one of which is generally indicated at 158. The manifold housings 154, 156 extend across the full width of the camouflage construction 50 adjacent to its path of movement.

As best seen in FIG. 10, first elongate manifold housing 154 is of a generally rectangular cross-sectional shape, and includes a first elongate gas receiving compartment 181, the ends of which are sealed by end wall plates suitably bolted thereto. Communicating with bottom wall plate through fluid inlet openings, one of which, 183, is shown in FIG. 10, and spaced approximately uniformly therealong are the air supply lines 146 from each of the electrical heaters 144.

The manifold housings 154, 156, are constructed in a range so that the flow path of gas through the first housing 154 is generally at a right angle to the discharge axis of the gas stream outlets of the second manifold housing 156.

Figure 11:
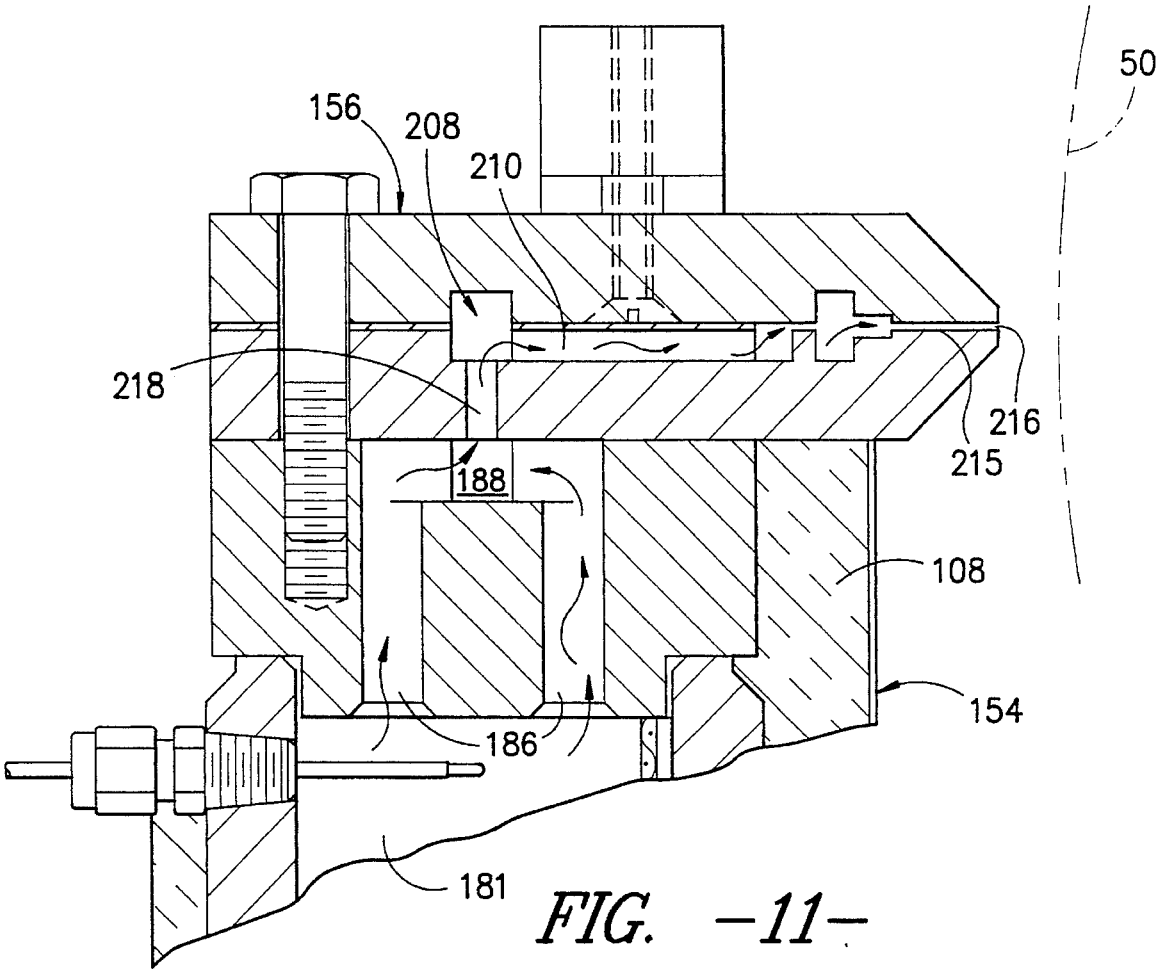
FIG. 11 is an enlarged broken away section view of the fluid stream distributing manifold housing of the manifold assembly as illustrated in FIG. 10.

As best seen in FIGS. 10 and 11, manifold housing 154 is provided with a plurality of gas flow passageways 186 which are disposed in uniformly spaced relation along the plate in two rows to connect the first gas receiving compartment 181 with a central elongate channel 188.

Baffle plate 192 serves to define a gas receiving chamber in the compartment 181 having side openings or slots 194 to direct the incoming heated air from the bank of heaters in a generally reversing path of flow through compartment 181. Disposed above channel-shaped baffle plate 192 is compartment 181 between the fluid inlet openings 183 and fluid outlet passages 186 is an elongate filter member 200 which is a generally J-shaped plate with a filter screen disposed thereabout.

Figure 12:
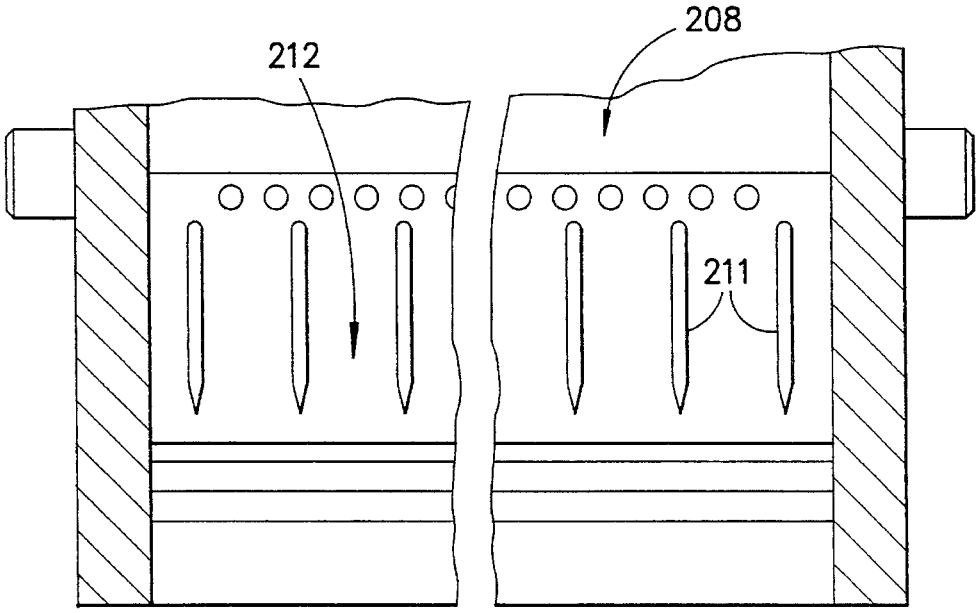
FIG. 12 is an enlarged broken away sectional view of an end portion of the fluid stream distributing manifold housing.

As seen in FIGS. 10, 11, and 12, a second smaller manifold housing 156 comprises first and second opposed elongated wall members, each of which has an elongate recess or channel 208 therein. Wall members are disposed in spaced, coextensive parallel relation with their recesses 208 in facing relation to form upper and lower wall portions of a second gas receiving compartment 210, in the second manifold housing 156. The gas then passes through a third gas receiving compartment 212 in the lower wall member of manifold housing 156 which is defined by small elongate islands 211 approximately uniformly spaced along the length of the member, as shown in FIG. 12. A continuous slit directs heated pressurized air from the third gas receiving compartment 212 in a continuous sheet across the width of the camouflage construction 50 at a substantially right angle on to the surface of the camouflage construction 50. Typically, in the treatment of camouflage constructions, the continuous slit 215 of manifold 156 may be 0.015 to about 0.030 of an inch in thickness. For precise control of the heated air streams striking the fabric, the continuous slit is preferably maintained between about 1.250 to 0.25 of an inch from the camouflage construction 50 being treated.

The second manifold housing 156 is provided with plurality of spaced gas inlet openings 218 (FIG. 11) which communicate with the elongate channel 188 of the first manifold housing 154 along its length through receives pressurized heated air from the first manifold housing 154 into the second gas receiving compartment 210.

The foregoing details of the construction and operation of the manifold assembly 130 of the gas treating apparatus are the subject matter of commonly assigned U.S. Pat. No. 4,471,514 entitled "Apparatus for Imparting Visual Surface Effects to Relatively Moving Materials" issued on Sep. 18, 1984. Disclosure thereof is included herein by reference for full description and clear understanding of the true features of the present invention.

However, the preferred means of heating the camouflage construction 50 is by a series of discrete streams instead of a continuous slit. Although discrete streams can be formed by using blocking steams of relatively cool gas which deflect and dilute selected lateral segments of the heated gas stream in accordance with pattern information that can be found in co-assigned U.S. Pat. No. 5,035,031, that issued on Jul. 30, 1991, which is incorporated by reference as is fully set forth herein and co-assigned U.S. Pat. No. 5,148,583 that issued on Sep. 22, 1992 which is incorporated by reference as is fully set forth herein, the most economical and therefore the preferred means of creating discrete streams would be to utilize a shim plate 102, which is fully disclosed in FIG. 8 of coassigned U.S. Pat. No. 4,499,637, that issued on Feb. 19, 1985, which is incorporated by reference as is fully set forth herein. The shim plate would be positioned in continuous slit 215 of manifold 156 as shown in FIG. 10. The width of the discrete stream of pressurized heated gas would preferable range between 0.030 and 0.250 of an inch. This width of a discrete steam may range from 0.010 to 2 inches. The spacing between discrete streams can vary as desired.

Additional information relating to the operation of such a pressurized heated gas apparatus, including more detailed description of patterning and control functions, can be found in co-assigned U.S. Pat. No. 4,393,563, that issued on Jul. 19, 1983 which is incorporated by reference as is fully set forth herein and co-assigned U.S. Pat. No. 4,364,156 that issued on Dec. 21, 1982 which is incorporated by reference as is fully set forth herein and co-assigned U.S. Pat. No. 4,418,451 that issued on Dec. 6, 1982, which is incorporated by reference as is fully set forth herein.

Figure 13:
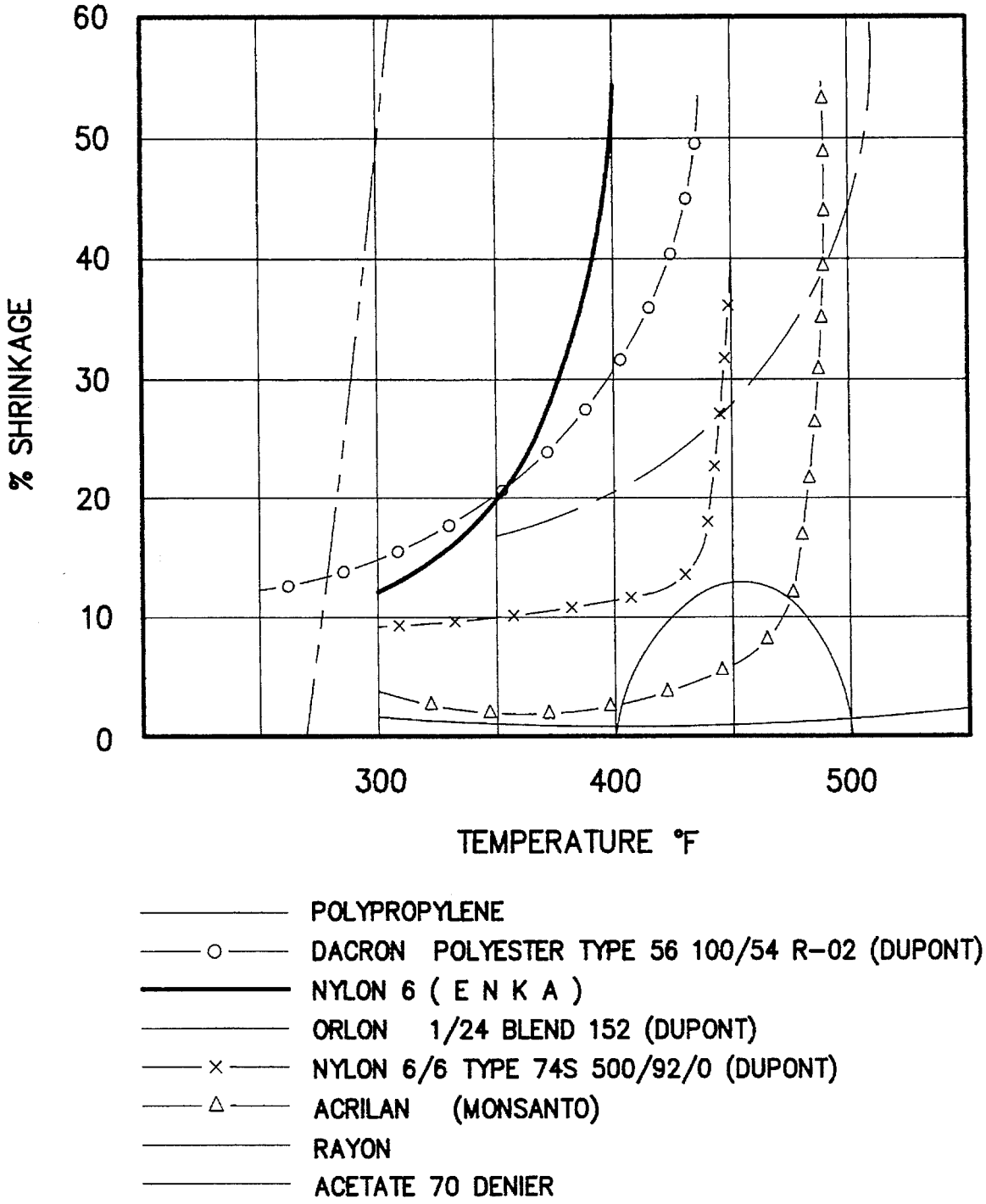
FIG. 13 is a graph comparing percentage of shrinkage as the function of temperature for a number of fiber types.

After receiving this heated gas treatment, the camouflage construction 50 now has a true and permanent third dimension by means of wrinkling, curling, and delustering. As seen in connection with FIG. 13, the amount of shrinkage of thermoplastic fiber is a function of the type of fiber involved and the temperature to which it is subjected. The temperature of the hot air is adjusted to accommodate a particular fiber so that the amount of shrinkage can be controlled regardless of the camouflage construction.

Figure 14:
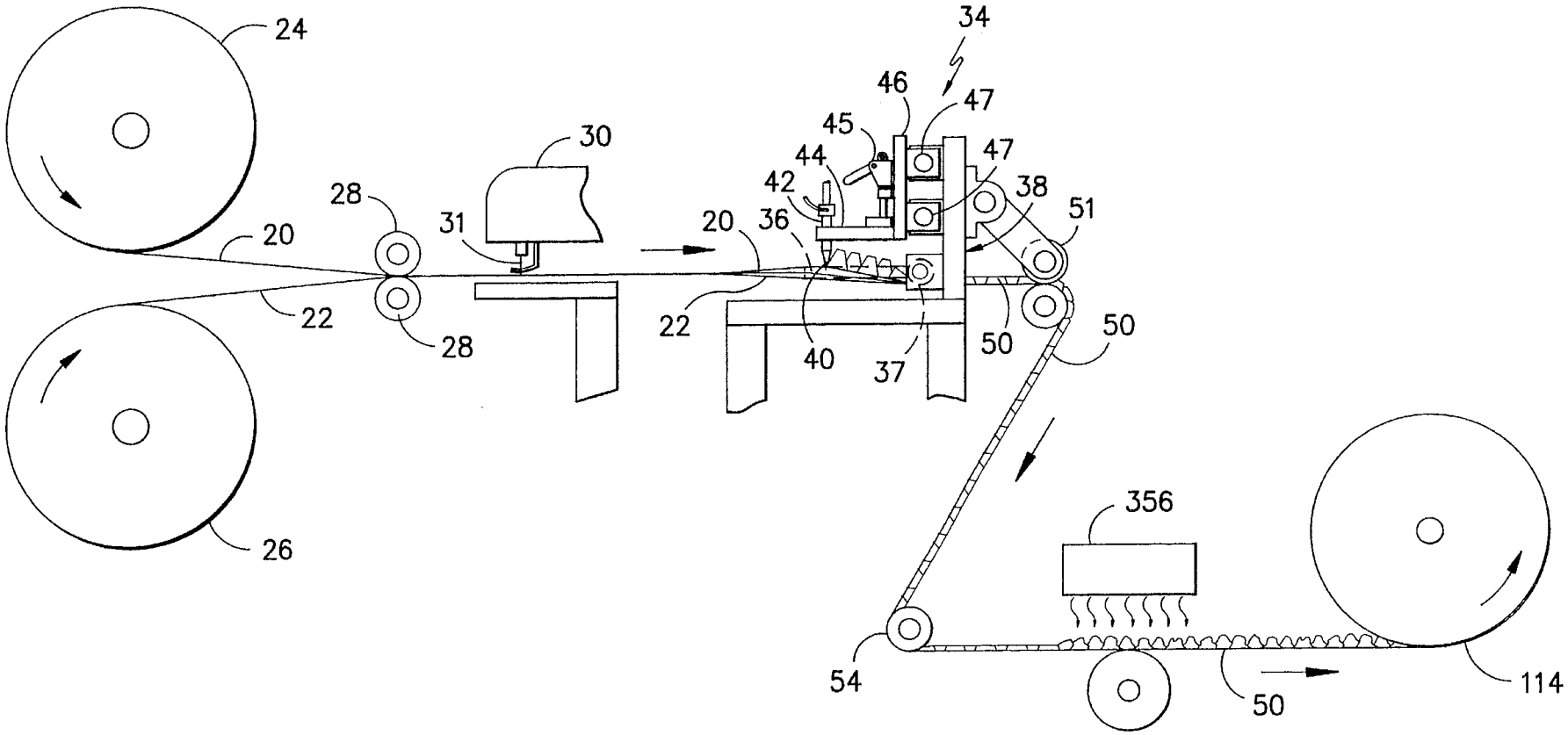
FIG. 14 is a schematic side elevation view of an alternative apparatus for wrinkling and delustering camouflage lobes utilizing infrared heat and incorporating novel features of the present invention.

The alternative embodiment utilized in wrinkling and delustering camouflage lobes involves the use of a infrared heater, as shown in FIG. 14. After the camouflage construction 50 leaves the cutting station 34 it goes through an infrared heater 356 which heats the camouflage lobes to temperatures of over 400 degrees Fahrenheit. This will extensively wrinkle and deluster the leaves as opposed to merely curling them and allowing them to move away from the mesh. The disadvantage of this method when contrasted to the heated gas method previously described is that the knitted mesh fabric 22 is also affected by the heat. Utilizing an 8.5 kilowatt infrared heater, the range of the camouflage construction 50 from the heater is typically between 4 to 6 inches. The camouflage construction speed can range from between 80 to 160 inches per minute under these parameters. It is felt that horizontal position of the camouflage construction provides for the most uniform fabric shrinkage. The temperature typically utilized by 8.5 kilowatt heater is in the range of 400 to 420 degrees Fahrenheit.

For both embodiments, the camouflage lobes are shrunk to a size that is 50 to 70 percent of the original camouflage lobes. The infrared treatment of camouflage lobes in this temperature range decreases the flatness characteristic of the camouflage system as well as providing a low degree of luster which is a significant advantage in preventing camouflage detection by the enemy. Furthermore, an observer standing under the net can easily, more accurately identify threats from the outside.

As this invention may be embodied in several forms without departing from the spirit or essential character thereof, embodiments presented here are intended to be illustrative and not descriptive. The scope of the invention is intended to be defined by the following appended claims rather than any descriptive matter here and above, and all embodiments of the invention which fall within the mean and range of equivalence of such claims are, therefore, intended to be embraced by such claims.

What is claimed is:

1. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes, each lobe having a base portion attached to the net substrate and an outer end portion free from the substrate, and heating said outer end portions to a temperature of over 400 degrees Fahrenheit thereby wrinkling and delustering said plurality of lobes.

2. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes, each lobe having a base portion attached to the net substrate and an outer end portion free from the substrate, and heating said outer end portions to a temperature in the range of 400 to 1100 degrees Fahrenheit thereby wrinkling and delustering said plurality of lobes.

3. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes, each lobe having a base portion attached to the net substrate and an outer end portion free from the substrate, and heating said outer end portions to a temperature in the range of 400 to 900 degrees Fahrenheit thereby wrinkling and delustering said plurality of lobes.

4. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes, each lobe having a base portion attached to the net substrate and an outer end portion free from the substrate, and heating said outer end portions to a temperature in the range of 400 to 600 degrees Fahrenheit thereby wrinkling and delustering said plurality of lobes.

5. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes, each lobe having a base portion attached to the net substrate and an outer end portion free from the substrate, and heating said outer end portions with pressurized heated gas to a temperature in the range of 400 to 1100 degrees Fahrenheit thereby wrinkling and delustering said plurality of lobes.

6. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes, each lobe having a base portion attached to the net substrate and an outer end portion free from the substrate, and heating said outer end portions with pressurized heated gas to a temperature in the range of 400 to 800 degrees Fahrenheit thereby wrinkling and delustering said plurality of lobes.

7. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes, each lobe having a base portion attached to the net substrate and an outer end portion free from the substrate, and heating said outer end portions with pressurized heated gas to a temperature in the range of 400 to 600 degrees Fahrenheit thereby wrinkling and delustering said plurality of lobes wherein said lobes are in a range of between fifty to seventy-five percent of original size prior to said step of heating.

8. A method of producing a composite camouflage construction from a composite material comprising a net substrate in contiguous facing relation with a continuous sheet of material and bonded thereto along plural spaced lines of attachment extending along a length of the composite construction, comprising the steps of:

passing the composite construction in a desired path of travel while spacing the sheet from the substrate between adjacent lines of attachment;

cutting the sheet between the adjacent lines of attachment to form a plurality of lobes, each lobe having a base portion attached to the net substrate and an outer end portion free from the substrate;

providing an elongate channel means extending across the width of said composite construction in spaced but closely adjacent relation to the exposed sheet surface, wherein said channel means is provided with a thin, elongate uninterrupted slit, said slit extending along the length of said channel means on the side of the channel facing the exposed sheet surface;

supplying the channel means with a uniformly heated, pressurized gas wherein a continuous, uninterrupted curtain of heated gas is projected from the slit onto the exposed sheet surface thereby wrinkling and delustering said plurality of lobes;

wherein the pressurized gas is heated to a temperature in the range of 400 to 1100 degrees Fahrenheit.

9. A method of producing a composite camouflage construction from a composite material comprising a net substrate in contiguous facing relation with a continuous sheet of material and bonded thereto along plural spaced lines of attachment extending along a length of the composite construction, comprising the steps of:

passing the composite construction in a desired path of travel while spacing the sheet from the substrate between adjacent lines of attachment;

cutting the sheet between the adjacent lines of attachment to form a plurality of lobes, each lobe having a base portion attached to the net substrate and an outer end portion free from the substrate;

providing an elongate channel means extending across the width of said composite construction in spaced but closely adjacent relation to the exposed sheet surface, wherein said channel means is provided with a thin, elongate uninterrupted slit, said slit extending along the length of said channel means on the side of the channel facing the exposed sheet surface;

providing one or more blocking means in said channel means to block defined portions of the slit; and supplying the channel means with a uniformly heated, pressurized gas wherein at least two discrete streams of heated gas are projected from the unblocked portions of the slit onto sections of the exposed sheet surface thereby wrinkling and delustering a plurality of lobes in those sections of the sheet surface while sections of the sheet opposite the blocking means remain untreated;

wherein the pressurized gas is heated to a temperature in the range of 400 to 1100 degrees Fahrenheit.

10. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes, each lobe having a base portion attached to the net substrate and an outer end portion free from the substrate, and heating said outer end portions with an infrared heater to a temperature in the range of 400 to 600 degrees Fahrenheit thereby wrinkling and delustering said plurality of lobes.

11. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes free from the substrate, each lobe having a base portion attached to the net substrate and an outer end portion, and heating said outer end portions with an infrared heater to a temperature in the range of 400 to 500 degrees Fahrenheit thereby wrinkling and delustering said plurality of lobes.

12. A method of producing a composite camouflage construction from a composite material comprising a net substrate in contiguous facing relation with a continuous sheet of material and bonded thereto along plural spaced lines of attachment extending along a length of the composite construction, comprising the steps of passing the composite construction in a desired path of travel while spacing the sheet from the substrate between adjacent lines of attachment, cutting the sheet between its adjacent lines of attachment to the substrate to form a plurality of lobes, each lobe having a base portion attached to the net substrate and an outer end portion free from the substrate, and heating said outer end portions with an infrared heater to a temperature in the range of 400 to 500 degrees Fahrenheit thereby wrinkling and delustering said plurality of lobes wherein said lobes are in a range of between fifty to seventy-five percent of original size prior to said step of heating.

* * * * *